US011685172B2

(12) United States Patent
Yajima

(10) Patent No.: US 11,685,172 B2
(45) Date of Patent: Jun. 27, 2023

(54) PRINTING APPARATUS AND CONVEYANCE CONTROL METHOD

(71) Applicant: Seiko Epson Corporation, Tokyo (JP)

(72) Inventor: Yasushi Yajima, Minowa-machi (JP)

(73) Assignee: Seiko Epson Corporation, Tokyo (JP)

( * ) Notice: Subject to any disclaimer, the term of this patent is extended or adjusted under 35 U.S.C. 154(b) by 10 days.

(21) Appl. No.: 17/355,604

(22) Filed: Jun. 23, 2021

(65) Prior Publication Data

US 2021/0402803 A1 Dec. 30, 2021

(30) Foreign Application Priority Data

Jun. 26, 2020 (JP) ..... JP2020-110251

(51) Int. Cl.

| | |
|---|---|
| ***B41J 11/00*** | (2006.01) |
| ***B41J 11/70*** | (2006.01) |
| ***B41J 3/60*** | (2006.01) |
| ***B41J 2/01*** | (2006.01) |
| ***B41J 13/00*** | (2006.01) |
| ***B41J 13/02*** | (2006.01) |

(52) U.S. Cl.

CPC ..... *B41J 11/0005* (2013.01); *B41J 2/01* (2013.01); *B41J 3/60* (2013.01); *B41J 11/007* (2013.01); *B41J 11/0024* (2021.01); *B41J 11/00242* (2021.01); *B41J 11/00244* (2021.01); *B41J 11/70* (2013.01); *B41J 13/009* (2013.01); *B41J 13/0018* (2013.01); *B41J 13/0045* (2013.01); *B41J 13/0054* (2013.01); *B41J 13/02* (2013.01)

(58) Field of Classification Search

CPC ..... B41J 11/0005; B41J 11/0022; B41J 11/00242; B41J 11/00244; B41J 11/007; B41J 11/70; B41J 3/60; B41J 2/01; B41J 13/0018; B41J 13/0045; B41J 13/0054; B41J 13/009; B41J 13/02

See application file for complete search history.

(56) References Cited

U.S. PATENT DOCUMENTS

| | | | | |
|---|---|---|---|---|
| 2003/0103132 | A1* | 6/2003 | Oshima | B65H 23/34 347/153 |
| 2010/0207975 | A1* | 8/2010 | Kawakami | B41J 29/393 347/19 |
| 2011/0227971 | A1* | 9/2011 | Hoshino | B41J 29/393 251/129.01 |
| 2018/0086116 | A1* | 3/2018 | Sumii | B41J 13/0009 |

FOREIGN PATENT DOCUMENTS

| | | |
|---|---|---|
| JP | 2007-144960 | 6/2007 |

* cited by examiner

*Primary Examiner* — Christopher E Mahoney
*Assistant Examiner* — Kendrick X Liu
(74) *Attorney, Agent, or Firm* — Workman Nydegger

(57) ABSTRACT

A printing apparatus includes a conveyance path including a curving part, an inversion path for inverting a medium upside down, and a control unit, and the control unit includes a first mode for conveying the long medium at a first speed when a surface that faces inside when the long medium is rolled in a roll shape and a surface that faces inside when conveyed in a curved shape through the curving part are the same, and a second mode for conveying the long medium at a second speed lower than the first speed of the first mode when the surface that faces inside when the long medium is rolled in the roll shape and the surface that faces inside when conveyed in the curved shape through the curving part are different from each other.

14 Claims, 11 Drawing Sheets

PRINTING APPARATUS AND CONVEYANCE CONTROL METHOD

The present application is based on, and claims priority from JP Application Serial Number 2020-110251, filed Jun. 26, 2020, the disclosure of which is hereby incorporated by reference herein in its entirety.

BACKGROUND

1. Technical Field

The present disclosure relates to a printing apparatus and a conveyance control method.

2. Related Art

In the related art, printing apparatuses that perform duplex printing on a roll sheet are known. For example, the ink-jet recording apparatus (printing apparatus) disclosed in JP-A-2007-144960 has a configuration in which after printing is performed on the first surface of a roll sheet, the sheet is cut into a single sheet medium and conveyed through the inversion path, and then printing is performed on the second surface.

JP-A-2007-144960 discloses a configuration for eliminating the so-called cockling, which is a phenomenon in which a roll sheet absorbed the solvent of liquid (ink) is wrinkled in a wavy shape; however, there is no disclosure of a configuration for eliminating the so-called curl, which is a winding shape of the roll sheet. Noted that if the curl is not corrected, failures such as head rubbing in which a front end portion of a medium makes contact with the head and rubs the head surface during printing at the printing unit and jam due to a medium caught in the printing unit and the like, are caused.

Therefore, correcting the curl is a challenge when duplex printing is performed on a roll sheet.

SUMMARY

A printing apparatus includes a curving part configured to convey a medium in a curved state, a printing unit configured to perform printing on the medium, a cutting unit configured to cut the medium on which printing was performed, an ejection part configured to eject the cut medium, a conveyance path including a conveyance unit configured to convey the medium through the curving part, the printing unit, the cutting unit, and the ejection part in this order, an inversion path configured to invert a single sheet medium upside down and merge the single sheet medium into an upstream part of the curving part of the conveyance path for printing on a second surface, the single sheet medium being formed by cutting a long medium on which printing is performed on a first surface, the medium being the long medium having a roll shape in an initial state, and a control unit configured to control the conveyance unit. In conveyance of the long medium or the single sheet medium at the curving part, the control unit controls the conveyance unit in a first mode and a second mode to convey the long medium or the single sheet medium toward the printing unit, the first mode being a mode for conveying the long medium or the single sheet medium at a first speed when a surface of the long medium or the single sheet medium being conveyed that faces inside when the long medium or the single sheet medium is rolled in a roll shape, and a surface of the long medium or the single sheet medium that faces inside of a curved shape when the long medium or the single sheet medium is conveyed through the curving part are the same, and the second mode being a mode for conveying the long medium or the single sheet medium at a second speed lower than the first speed of the first mode when the surface of the long medium or the single sheet medium being conveyed that faces inside when the long medium or the single sheet medium is rolled in the roll shape, and the surface of the long medium or the single sheet medium that faces inside of the curved shape when the long medium or the single sheet medium is conveyed through the curving part are different from each other.

A conveyance control method of a medium uses a printing apparatus configured to perform printing on the medium, the medium being a long medium having a roll shape in an initial state, the printing apparatus including a curving part configured to convey a medium in a curved state, a printing unit configured to perform printing on the medium, a cutting unit configured to cut the medium on which printing was performed, an ejection part configured to eject the cut medium, a conveyance path including a conveyance unit configured to convey the medium through the curving part, the printing unit, the cutting unit, and the ejection part in this order, and an inversion path configured to invert a single sheet medium upside down and merge the single sheet medium into an upstream part of the curving part of the conveyance path for printing on a second surface, the single sheet medium being formed by cutting the long medium on which printing is performed on a first surface, the method including, in conveyance of the long medium or the single sheet medium at the curving part a first mode step for conveying the long medium or the single sheet medium at a first speed when a surface of the long medium or the single sheet medium being conveyed that faces inside when the long medium or the single sheet medium is rolled in a roll shape, and a surface of the long medium or the single sheet medium that faces inside of a curved shape when the long medium or the single sheet medium is conveyed through the curving part are the same, and a second mode step for conveying the long medium or the single sheet medium at a second speed lower than the first speed of the first mode when the surface of the long medium or the single sheet medium being conveyed that faces inside when the long medium or the single sheet medium is rolled in the roll shape, and the surface of the long medium or the single sheet medium that faces inside of the curved shape when the long medium or the single sheet medium is conveyed through the curving part are different from each other.

DESCRIPTION OF EXEMPLARY EMBODIMENTS

1. First Embodiment

Figure 1:
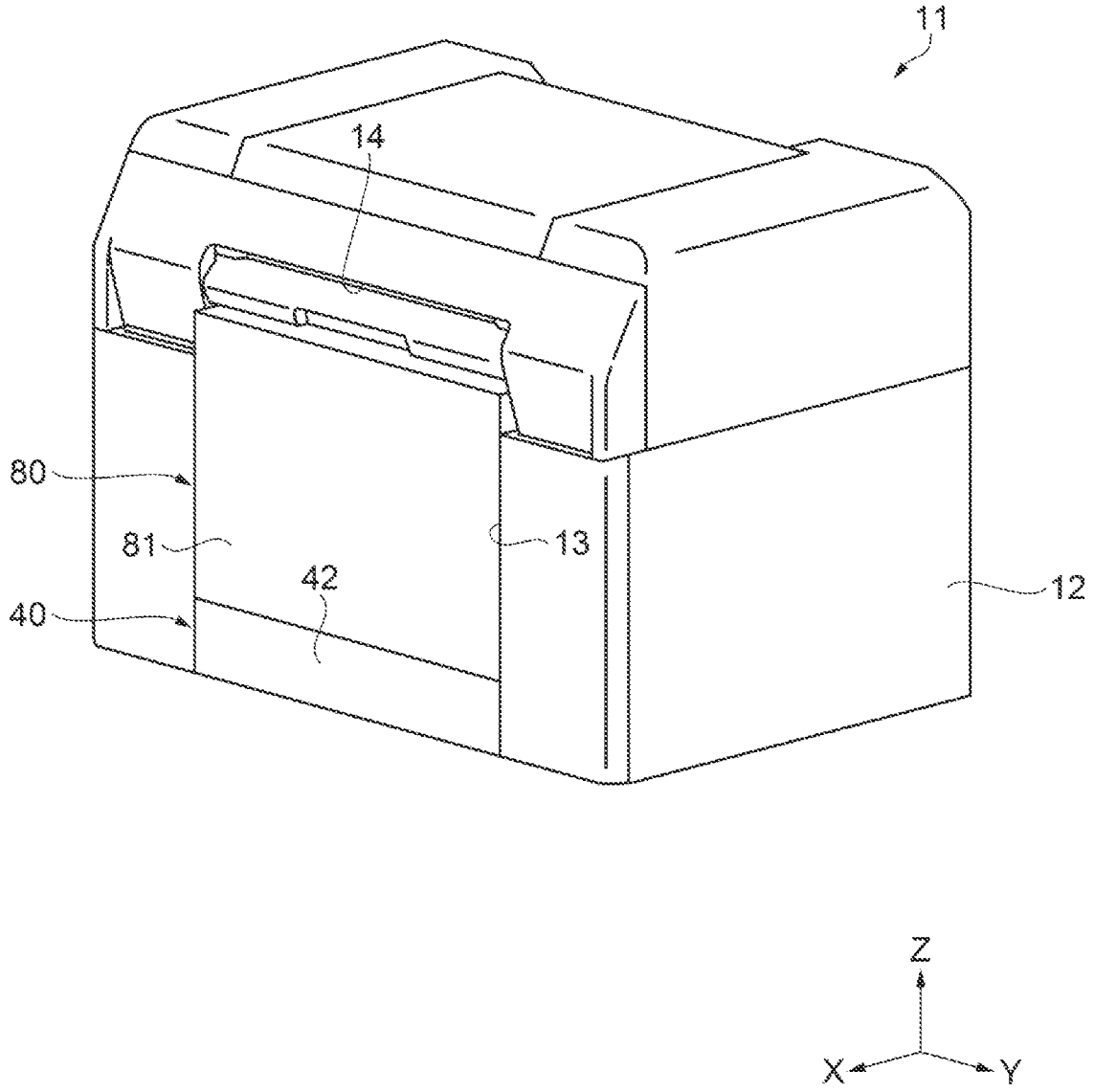
FIG. 1 is a perspective view illustrating an external appearance of a printing apparatus according to a first embodiment.

A general configuration of a printing apparatus 11 according to the first embodiment is described below.

The printing apparatus 11 of the present embodiment is an ink-jet printing apparatus that performs printing by discharging ink to a medium for printing. In addition, the printing apparatus 11 uses a roll sheet R in the form of a roll of a long medium A1 serving as a medium.

In the drawings described below, on the assumption that the printing apparatus 11 is placed on a horizontal plane, the front-rear direction of the printing apparatus 11 is the X direction and the left-right direction (or the width direction) is the Y direction, as the directions along the horizontal plane. In addition, the direction (vertical direction) perpendicular to the horizontal plane is the Z direction. In addition, the +X direction is the front direction, the −X direction is the rear direction, the +Y direction is the right direction, the −Y direction is the left direction, the +Z direction is the up direction, and the −Z direction is the down direction.

Figure 2:
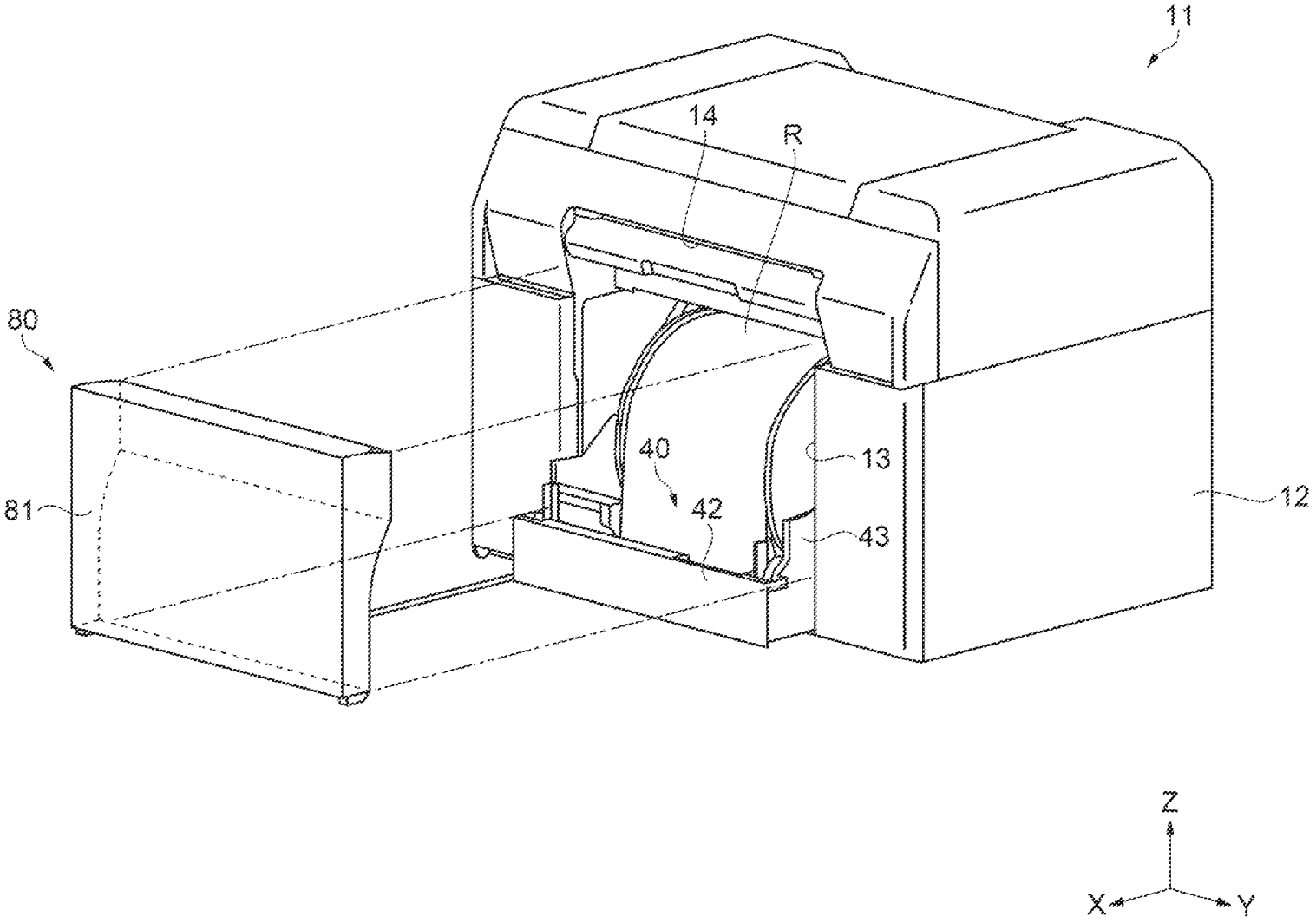
FIG. 2 is a perspective view illustrating a state where a roll sheet housing unit is pulled out and a cutting waste housing unit is detached.
Figure 3:
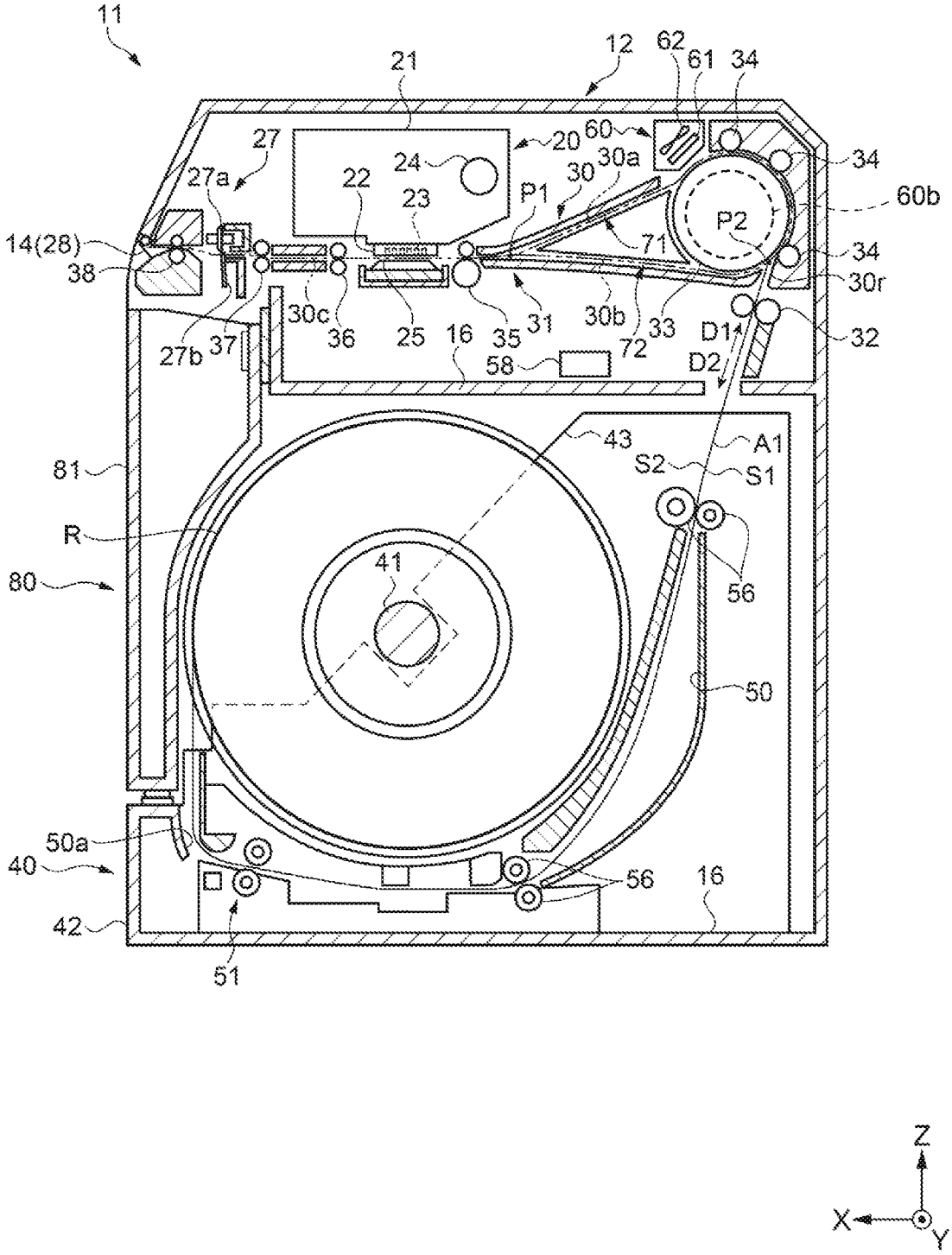
FIG. 3 is a schematic sectional view illustrating an internal configuration of the printing apparatus.

As illustrated in FIG. 1 to FIG. 3, the printing apparatus 11 includes a cuboid housing 12, and a body frame 16 that supports each part of the printing apparatus 11. The housing 12 includes an opening 13 that opens at the front surface. In addition, in the housing 12, an ejection port 14 that ejects printed and cut mediums is disposed. Noted that the ejection port 14 constitutes an ejection part 28.

The printing apparatus 11 includes a roll sheet housing unit 40 that houses the roll sheet R and sends out the housed roll sheet R. The roll sheet housing unit 40 is disposed such that it can be pulled out to the front side from the housing 12 through the opening 13. The roll sheet housing unit 40 includes a front plate part 42 that constitutes a part of the exterior of the printing apparatus 11, and a pair of support walls 43 that rotatably supports the roll sheet R, in the state where the roll sheet housing unit 40 is housed in the housing 12.

A box-shaped cutting waste housing unit 80 that houses the cutting waste of the medium generated through cutting performed by a cutting unit 27 is provided below the ejection part 28. The cutting waste housing unit 80 is detachably disposed at the front surface of the housing 12 in front of the roll sheet R. The cutting waste housing unit 80 closes the opening 13 by being attached to the housing 12. The cutting waste housing unit 80 includes an exterior wall 81 that constitutes a part of the exterior of the printing apparatus 11 in the state where the cutting waste housing unit 80 is attached to the housing 12.

When the cutting waste housing unit 80 is detached from the housing 12, the roll sheet housing unit 40 can be pulled out from the housing 12. The roll sheet R is replaced in the state where the roll sheet housing unit 40 is pulled out from the housing 12.

As illustrated in FIG. 3, the printing apparatus 11 includes a conveyance path 30 (indicated by the chain double-dashed line in the drawing) through which the medium is conveyed. The printing apparatus 11 includes a conveyance unit 31 that conveys the medium along the conveyance path 30, a printing unit 20 that performs printing on the medium, and the cutting unit 27 that cuts the medium.

Noted that in the present embodiment, the long medium A1 supplied from the roll sheet housing unit 40, and a single sheet medium A2 that is formed by cutting the long medium A1 on which printing has been performed are collectively referred to as the medium. It should be noted that the medium cut by the cutting unit 27 is the long medium A1. In addition, the medium subjected to the printing at the printing unit 20 is the long medium A1 and the single sheet medium A2 that is formed by cutting the long medium A1.

As illustrated in FIG. 3, the printing unit 20 performs printing on the long medium A1 supplied from the roll sheet housing unit 40 and the single sheet medium A2 formed by cutting the long medium A1. The printing unit 20 includes a head 22 including a nozzle 23 that discharges ink toward the medium, a carriage 21 on which the head 22 is mounted, and a guide rail 24 disposed along the width direction. In addition, the printing unit 20 includes a movement mechanism (omitted in the drawing) that moves the carriage 21 back and forth along the guide rail 24. A supporting part 25 that supports the medium is provided at a position opposite to the head 22.

The head 22 performs printing on the medium supported by the supporting part 25 by discharging ink while moving back and forth in the width direction of the medium together with the carriage 21. While the printing unit 20 is described as a serial head type in which the head 22 moves back and forth in the width direction in the present embodiment, the printing unit may be of a line head type in which a head extended in the width direction is disposed in a fixed manner.

The conveyance path 30 is a space where the medium can move, and is composed of a plurality of members. The conveyance path 30 is provided in the range from the roll sheet housing unit 40 located most upstream for sending out the roll sheet R, to the ejection part 28 (the ejection port 14) located most downstream. The printing unit 20, the supporting part 25 and the like constitute a part of the conveyance path 30.

The cutting unit 27 is located downstream of the supporting part 25, and is located upstream of the ejection port 14. The cutting unit 27 of the present embodiment is a movable blade 27*a* that can move back and forth in the width direction (left-right direction), and a fixed blade 27*b* that is not movable. The movable blade 27*a* is provided above the conveyance path 30, and the fixed blade 27*b* is provided below the conveyance path 30. The cutting unit 27 cuts the medium (the long medium A1) across the width direction at a cutting position. The cutting position is the position of the cutting edge of the fixed blade 27*b*.

The conveyance path 30 includes a supply path 30*a* and an inversion path 30*b* disposed upstream of the supporting part 25, and an ejection path 30*c* disposed downstream of the supporting part 25. Further, the supply path 30*a* includes a roll sheet supply path 30*r* where the long medium A1 is supplied.

The supply path 30*a* is a path that connects the roll sheet housing unit 40 and the supporting part 25. The inversion path 30*b* is a path that connects a branch point P1 branched from the supply path 30*a* and a confluence point P2 that joins the supply path 30*a*. In the supply path 30*a*, the confluence point P2 is located upstream of the branch point P1. The ejection path 30*c* is a path that connects the supporting part 25 and the ejection part 28 (the ejection port 14).

The conveyance path 30 includes the conveyance unit 31 that conveys the medium in the order of, basically, an intermediate roller 33, the printing unit 20, the cutting unit 27, and the ejection part 28. The conveyance unit 31 sends and conveys the long medium A1 out of the roll sheet R. The conveyance unit 31 also conveys the single sheet medium A2 formed by cutting the long medium A1. The conveyance unit 31 includes a supply roller pair 32, the intermediate roller 33 serving as a curving part, a driven roller 34, and an upstream conveyance roller pair 35, which are sequentially provided in the supply path 30*a* from the upstream side. Noted that the conveyance unit 31 includes a plurality of (in the present embodiment, three) driven rollers 34. The driven roller 34 is rotatably provided, and is driven into rotation with the medium sandwiched between it and the intermediate roller 33.

The conveyance unit 31 further includes a downstream conveyance roller pair 36, a first roller pair 37, and a second roller pair 38, which are sequentially provided from the upstream side in the ejection path 30*c*. The first roller pair 37 is located upstream of the cutting unit 27. The second roller pair 38 is located downstream of the cutting unit 27.

Here, a path that conveys the long medium A1 or the single sheet medium A2 in the order of the curving part (the intermediate roller 33), the printing unit 20 (the supporting part 25), the cutting unit 27, and the ejection part 28 is referred to as a conveyance path 71. The conveyance path 71 is composed of the supply path 30*a* (including the roll sheet supply path 30*r*) and the ejection path 30*c* that constitute the conveyance path 30. In addition, the conveyance path 71 is composed of the conveyance unit 31, the printing unit 20 (the supporting part 25), the cutting unit 27, the ejection part 28 and the like.

In addition, a path that conveys (inverts) the single sheet medium A2 in the order of the ejection part 28, the cutting unit 27, the printing unit 20 (the supporting part 25), and the curving part (the intermediate roller 33) is referred to as an inversion path 72. The inversion path 72 is composed of the ejection path 30*c* and the inversion path 30*b* that constitute the conveyance path 30. In addition, as with the conveyance path 71, the inversion path 72 is composed of the conveyance unit 31, the printing unit 20 (the supporting part 25) and the like. Noted that the inversion path 72 serves as a path for inverting upside down the single sheet medium A2 formed through printing and cutting of the long medium A1.

In the present embodiment, the conveyance path 71 and the inversion path 72 are paths overlapping each other at the supporting part 25 as the region opposite to the printing unit 20, the ejection path 30*c*, and the cutting unit 27, and convey the long medium A1 or the single sheet medium A2 in opposite directions.

Now a configuration of the roll sheet housing unit 40 is described.

In the roll sheet housing unit 40, the roll sheet R is rotatably supported by a support shaft 41 extending in the width direction of the housing 12. The support shaft 41 is configured to be driven into rotation in both the forward direction and the reverse direction. Accordingly, the roll sheet R is driven into rotation in both the forward direction and the reverse direction through the support shaft 41. In addition, the roll sheet housing unit 40 is provided with a roll sheet conveyance path 50 for conveying, toward the roll sheet supply path 30*r*, the long medium A1 sent out from the roll sheet R.

The roll sheet conveyance path 50 extends from the front side toward the bottom side of the roll sheet R supported through the support shaft 41, and then bends rearward in such a manner as to extend up to the roll sheet supply path 30*r* at a position higher than the roll sheet R through the bottom side and the rear side of the roll sheet R.

The roll sheet conveyance path 50 includes a bent portion 50*a* that is bent at a substantially right angle at an upstream end portion thereof, or more specifically, at a position on the lower front side of the roll sheet R in the roll sheet conveyance path 50. An uncurling mechanism 51 for performing uncurling to correct a bend of the long medium A1 sent out from the roll sheet R is provided on the side downstream of the bent portion 50*a* in the roll sheet conveyance path 50.

On the side downstream of the uncurling mechanism 51 in the roll sheet conveyance path 50, a roll sheet conveyance roller pair 56 that applies a conveyance force to the roll sheet R is disposed with an appropriate distance therebetween. When the roll sheet conveyance roller pair 56 is driven into rotation, the long medium A1 is sent out from the roll sheet R and conveyed to the roll sheet supply path 30*r*.

The supply roller pair 32, the intermediate roller 33, the driven roller 34, the upstream conveyance roller pair 35, the downstream conveyance roller pair 36, the first roller pair 37, and the second roller pair 38 convey a medium by rotating with the medium sandwiched therebetween.

The conveyance unit 31 conveys the medium from the upstream side to the downstream side when driven in the normal rotation, and conveys the medium from the downstream side to the upstream side when driven in the reverse rotation. In the present embodiment, the downstream direction along the conveyance path 30 is referred to as a forward direction D1, and the upstream direction along the conveyance path 30 is referred to as a reverse direction D2.

The printing apparatus 11 includes a control unit 58 that controls various operations executed by the printing apparatus 11. The control unit 58 is composed of, for example, a computer, a processing circuit including a memory or the like, and controls the printing unit 20, the cutting unit 27, the conveyance unit 31 and the like in accordance with a program stored in the memory.

The printing apparatus 11 includes a heating unit 60 that performs heating of the medium being conveyed. The heating unit 60 is located at a position opposite to the intermediate roller 33 disposed in the supply path 30*a*, and is disposed immediately downstream of the most downstream driven roller 34 of the three driven rollers 34. The heating unit 60 is configured to correct the winding shape of the medium. The heating unit 60 of the present embodiment is composed of a heater 61 that generates heat and a fan 62 that injects the heat generated by the heater 61 to the medium.

Next, a medium conveyance operation and a conveyance control method are described.

The printing apparatus 11 includes a sensor that detects the rotation amounts of the intermediate roller 33, the upstream conveyance roller pair 35 and the like. In addition, the printing apparatus 11 includes a sensor that detects the medium. The control unit 58 performs the drive control of each mechanism on the basis of the detection results of the sensors.

Figure 4:
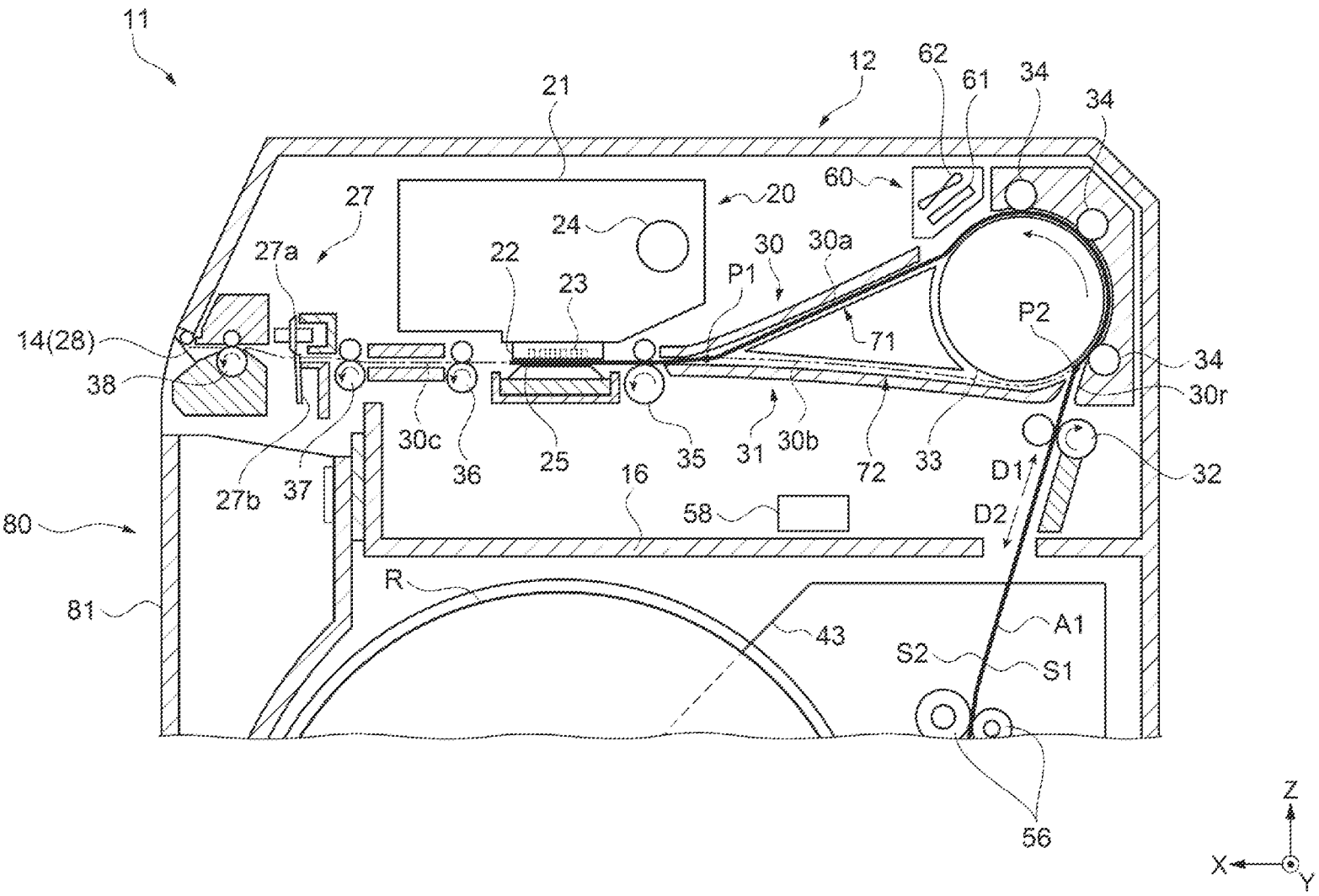
FIG. 4 is a sectional view illustrating a state where a long medium is conveyed along a supply path to a supporting part.

As illustrated in FIG. 4, the control unit 58 conveys the medium (the long medium A1) sent out from the roll sheet R to the supporting part 25 along the supply path 30*a* including the roll sheet conveyance path 50 (see FIG. 3) by driving the conveyance unit 31 including the roll sheet conveyance roller pair 56. More specifically, the control unit 58 conveys the long medium A1 sent out from the roll sheet housing unit 40 to the supporting part 25 by driving the conveyance unit 31 in the normal rotation and conveying the long medium A1 in the forward direction D1.

Noted that in the present embodiment, during conveyance at the intermediate roller 33 serving as a curving part as a middle point of conveyance of the long medium A1 toward the supporting part 25, the control unit 58 controls the conveyance speed of the conveyance unit 31 including the intermediate roller 33. In addition, the control unit 58 forms the single sheet medium A2 by cutting the printed long medium A1. Then, to perform printing by inverting the single sheet medium A2 upside down, the control unit 58 controls the conveyance speed of the conveyance unit 31 including the intermediate roller 33 when conveying the medium through the inversion path 30*b* and merging it into the intermediate roller 33. In this manner, the control unit 58 controls the conveyance speed of the conveyance unit 31 including the intermediate roller 33 in two modes when conveying the long medium A1 or the single sheet medium A2 through the intermediate roller 33.

The two modes (a first mode and a second mode) of the control unit 58 are described below.

First, the surface of the long medium A1 or the single sheet medium A2 that faces outside when it is rolled in a roll shape is referred to as a first surface S1. In addition, the surface that faces inside when it is rolled in a roll shape is referred to as a second surface S2. Noted that in the present embodiment, the printing to the long medium A1 is performed on the first surface S1, and the printing to the single sheet medium A2 is performed on the second surface S2.

The first mode is a mode for conveying the long medium A1 or the single sheet medium A2 at a first speed in the case where the second surface S2 of the long medium A1 or the single sheet medium A2 being conveyed that faces inside when it is rolled in a roll shape, and the surface of the long medium A1 or the single sheet medium A2 that faces inside when the long medium A1 or the single sheet medium A2 is conveyed through the intermediate roller 33 (curving part) in a curved shape along the curved shape of the roller are the same. In addition, the driving of the control unit 58 in the first mode is the same as implementation of the "the first mode step".

The second mode is a mode for conveying the long medium A1 or the single sheet medium A2 at a second speed lower than the first speed of the first mode in the case where the second surface S2 of the long medium A1 or the single sheet medium A2 being conveyed that faces inside when it is rolled in a roll shape and the surface of the long medium A1 or the single sheet medium A2 that faces inside when the long medium A1 or the single sheet medium A2 is conveyed through the intermediate roller 33 (curving part) in a curved shape along the curved shape of the roller are different from each other. In addition, the driving of the control unit 58 in the second mode is the same as implementation of the "the second mode step".

In the second mode, the control unit 58 controls the heating unit 60 that performs heating of the long medium A1 or the single sheet medium A2 located at the intermediate roller 33. Noted that the heating unit 60 is not driven in the first mode.

In the present embodiment, when the long medium A1 sent out from the roll sheet R is conveyed through the intermediate roller 33, the second surface S2 (the surface that faces inside when it is rolled in a roll shape) of the long medium A1 and the surface (in this case, the second surface S2) of the long medium A1 that faces inside when the long medium A1 is conveyed through the intermediate roller 33 in a curved shape are the same. Therefore, for the long medium A1, the control unit 58 drives the conveyance unit 31 including the intermediate roller 33 in the first mode. In other words, the control unit 58 implements the first mode step. Specifically, the control unit 58 conveys the long medium A1 in the forward direction D1 by driving the conveyance unit 31 in the normal rotation at the first speed set as the first mode.

When the long medium A1 is conveyed along the supply path 30*a* to the supporting part 25 through the intermediate roller 33, the control unit 58 causes the printing unit 20 to perform printing by discharging ink to the long medium A1 located at the supporting part 25 while causing the conveyance unit 31 to convey the long medium A1 in the forward direction D1. Specifically, the printing unit 20 performs printing on the first surface S1 of the long medium A1.

The control unit 58 conveys, in the forward direction D1, the long medium A1 on which printing has been performed by the printing unit 20 by driving the conveyance unit 31 in the normal rotation. Then, when the printed portion in the long medium A1 has passed through the cutting position, the control unit 58 stops the conveyance of the long medium A1.

Figure 5:
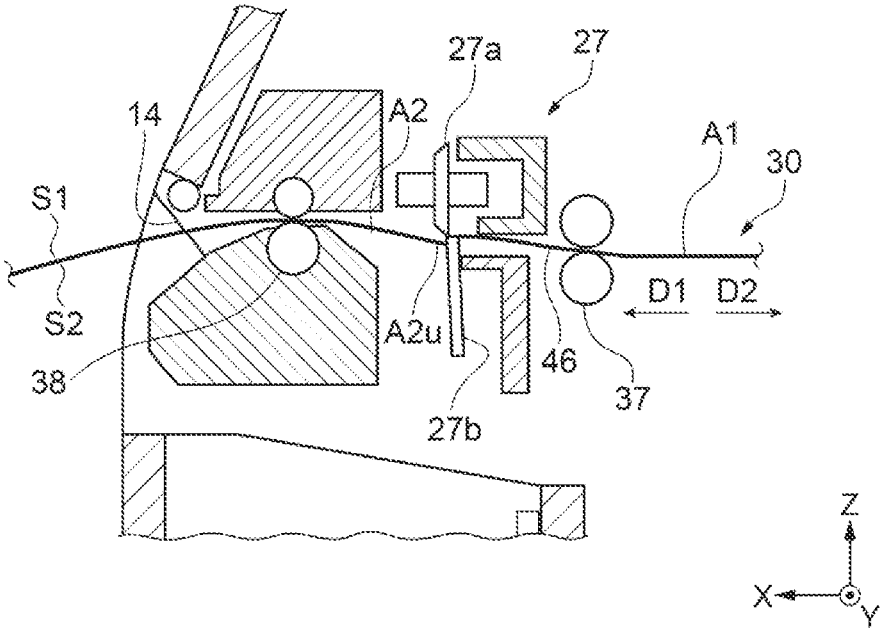
FIG. 5 is a sectional view illustrating a state where the long medium is cut.

Next, as illustrated in FIG. 5, the control unit 58 causes the cutting unit 27 to cut the printed long medium A1. The cutting unit 27 cuts the long medium A1 whose conveyance is stopped into a base portion 46 upstream of the cutting unit 27 and the single sheet medium A2 as a cut piece downstream of the cutting unit 27. The single sheet medium A2 is formed through this cutting of the long medium A1 at the cutting unit 27. At this time, the first roller pair 37 holds the base portion 46 at a position upstream of the cutting unit 27. In addition, the second roller pair 38 holds the single sheet medium A2 at a position downstream of the cutting unit 27.

Figure 6:
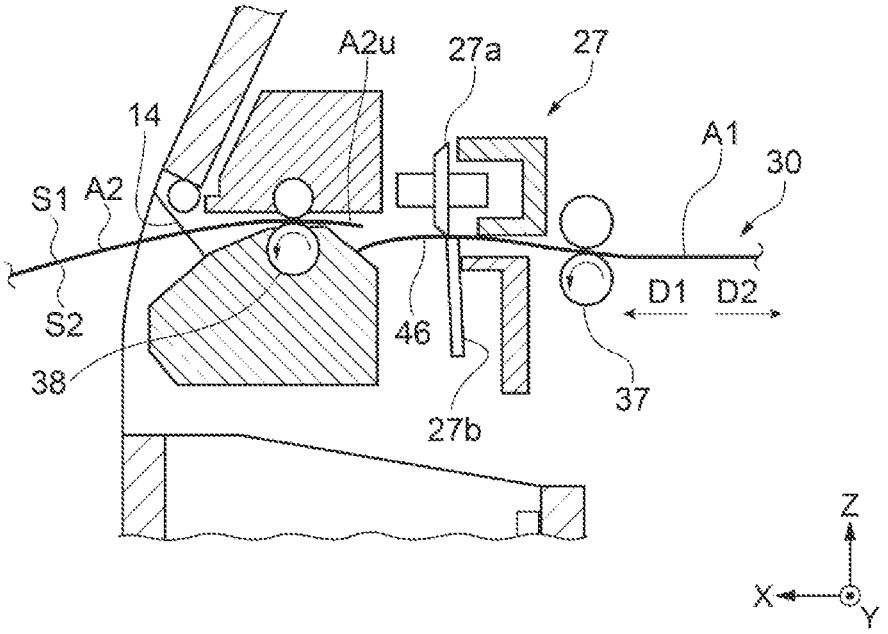
FIG. 6 is a sectional view illustrating a state where a single sheet medium formed through cutting is overlayed on the long medium.
Figure 7:
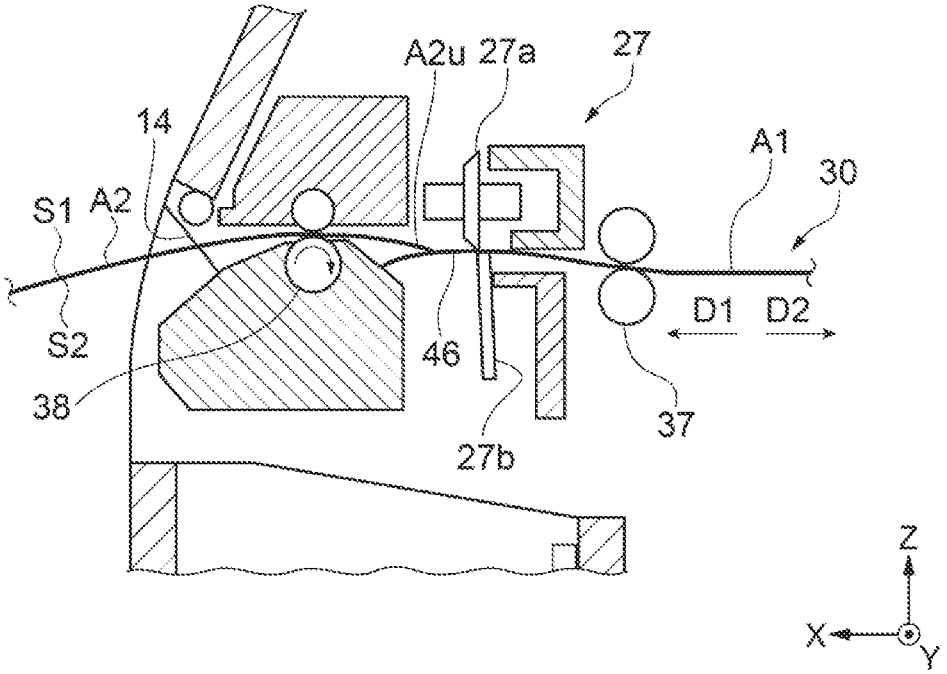
FIG. 7 is a sectional view illustrating a state where the single sheet medium formed through cutting is overlayed on the long medium.

Next, as illustrated in FIG. 6, the control unit 58 conveys the base portion 46 and the single sheet medium A2 in the forward direction D1 by a predetermined amount by driving the conveyance unit 31 in the normal rotation. Subsequently, as illustrated in FIG. 7, the control unit 58 drives the second roller pair 38 in the reverse rotation in the state where the driving of the first roller pair 37 is stopped. Through this operation, an upstream end A2*u* of the single sheet medium A2 is overlayed on the top of the base portion 46.

Next, the control unit 58 causes the sheet to pass through the cutting unit 27 with the upstream end A2*u* of the single sheet medium A2 overlapping the base portion 46 by driving the first roller pair 37 in the reverse rotation with the second roller pair 38 driven in the reverse rotation.

Next, together with the first roller pair 37, the control unit 58 drives the downstream conveyance roller pair 36, the upstream conveyance roller pair 35, the intermediate roller 33, and the supply roller pair 32 in the reverse rotation. The conveyance unit 31 conveys the upstream end A2*u* of the single sheet medium A2 to a position upstream of the upstream conveyance roller pair 35 with the upstream end A2*u* of the single sheet medium A2 overlapping the base portion 46.

When the overlapping portion of the single sheet medium A2 and the base portion 46 has passed through the upstream conveyance roller pair 35, the control unit 58 stops the reverse driving of the upstream conveyance roller pair 35, the downstream conveyance roller pair 36, the first roller pair 37, and the second roller pair 38. More specifically, when the overlapping portion of the single sheet medium A2 and the base portion 46 is located upstream of the upstream conveyance roller pair 35 and the upstream end A2*u* of the single sheet medium A2 is located between the upstream conveyance roller pair 35 and the branch point P1 where the supply path 30*a* branches off from the inversion path 30*b*, the control unit 58 stops the conveyance of the single sheet medium A2.

Figure 8:
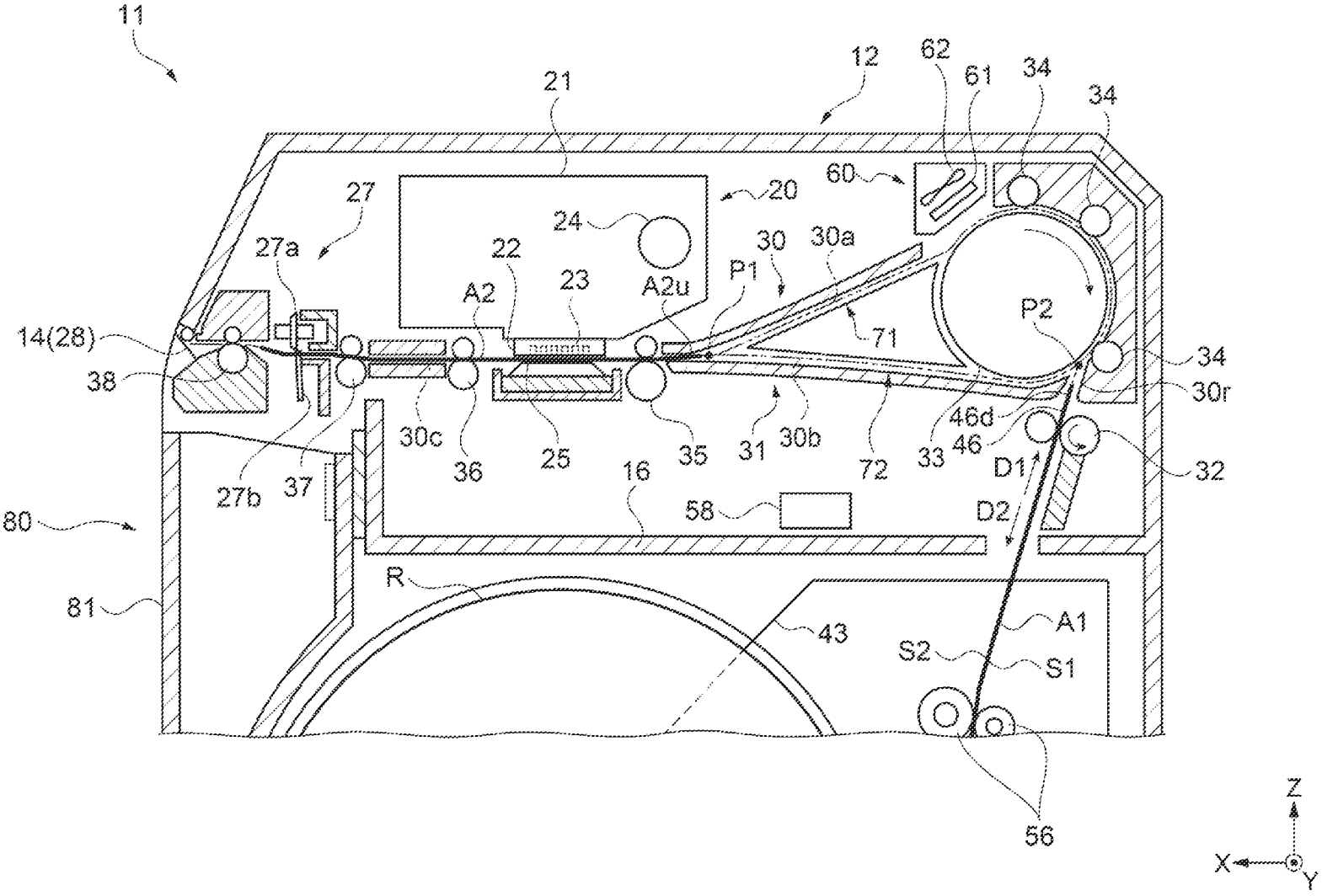
FIG. 8 is a sectional view illustrating a state where the single sheet medium and the long medium are conveyed in a reverse rotation.

Next, as illustrated in FIG. 8, the control unit 58 continues the reverse driving of the intermediate roller 33 and the supply roller pair 32 in the state where the reverse driving of the upstream conveyance roller pair 35, the downstream conveyance roller pair 36, the first roller pair 37, and the second roller pair 38 is stopped. In this manner, while the single sheet medium A2 remains with the upstream end A2*u* being located between the upstream conveyance roller pair 35 and the branch point P1, the base portion 46 is conveyed in the reverse direction D2 via the intermediate roller 33. Then, when a downstream end 46*d* of the base portion 46 is located at the roll sheet supply path 30*r* after passing through the confluence point P2 via the intermediate roller 33, the control unit 58 stops the reverse driving of the intermediate roller 33 and the supply roller pair 32.

Figure 9:
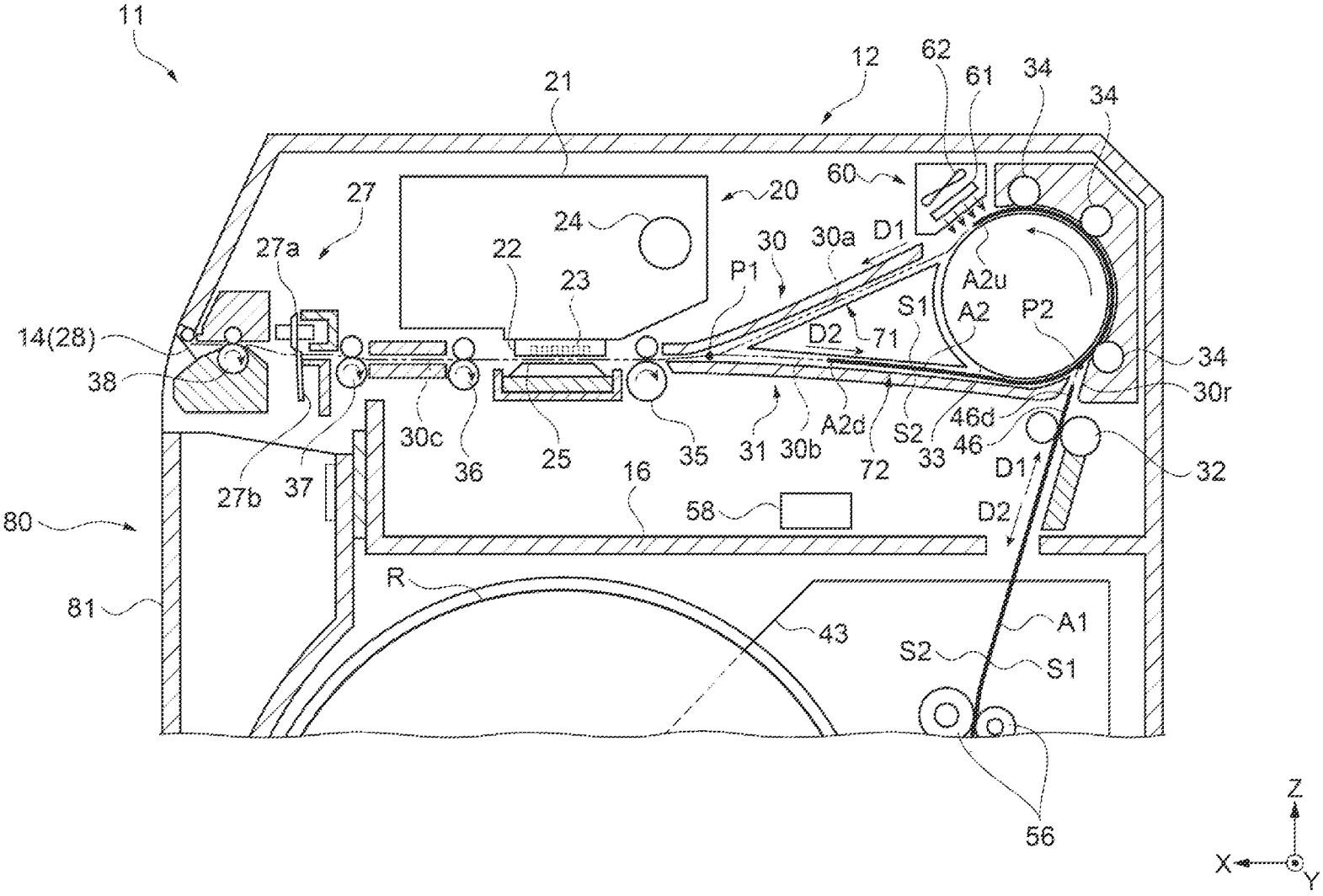
FIG. 9 is a sectional view illustrating a state where the single sheet medium is inverted upside down at an inversion path.

Next, as illustrated in FIG. 9, to perform printing on the second surface S2 by inverting the single sheet medium A2 upside down, the control unit 58 conveys the sheet such that the second surface S2 becomes the upper surface. Specifically, in the state where the reverse driving of the supply roller pair 32 is stopped, the control unit 58 drives the intermediate roller 33 in the normal rotation, and drives the upstream conveyance roller pair 35, the downstream conveyance roller pair 36, the first roller pair 37, and the second roller pair 38 in the reverse rotation. The conveyance unit 31 conveys the single sheet medium A2 in the reverse direction D2 to send it from the branch point P1 to the inversion path 30*b* and return it to the supply path 30*a* from the confluence point P2. The single sheet medium A2 returned to the supply path 30*a* is conveyed through the intermediate roller 33 and conveyed through the supply path 30*a* in the forward direction D1.

Then, when the rear end portion (the downstream end A2*d* of the single sheet medium A2) of the single sheet medium A2 in the travelling direction has passed through the upstream conveyance roller pair 35, the control unit 58 switches, to the normal rotation, the driving of the upstream conveyance roller pair 35, the downstream conveyance roller pair 36, the first roller pair 37, and the second roller pair 38 that have been driven in the reverse rotation. In this manner, the upstream side and the downstream side of the single sheet medium A2 are switched such that the upstream end A2*u* becomes the most downstream end, and the sheet is inverted upside down such that the second surface S2 becomes the upper surface.

Noted that in the present embodiment, in the case where the single sheet medium A2 having been conveyed through the inversion path 30*b* is conveyed through the intermediate roller 33, the second surface S2 (the surface that faces inside when it is rolled in a roll shape) of the single sheet medium A2 and the surface (in this case, the first surface S1) of the single sheet medium A2 that faces inside when it is conveyed through the intermediate roller 33 in a curved shape along the curved shape of the roller are different from each other. Therefore, for the single sheet medium A2, the control unit 58 drives the conveyance unit 31 including the intermediate roller 33 in the second mode. In other words, the control unit 58 implements the second mode step.

The control unit 58 may implement the second mode when the front end portion (the upstream end A2*u* of the single sheet medium A2) of the single sheet medium A2 in the travelling direction is located at the intermediate roller 33. The reason for this is that the front end portion is easily brought into contact with the head 22 of the printing unit 20 and is easily caught in the printing unit 20 when it is conveyed by being sandwiched only by the upstream conveyance roller pair 35. Then, the control unit 58 conveys the single sheet medium A2 in the forward direction D1 by driving the conveyance unit 31 including the intermediate roller 33 in the normal rotation at the second speed lower than the first speed of the first mode.

Noted that the long medium A1 of the present embodiment has a curl of a winding shape with the second surface S2, which faces inside in the state where it is rolled, curved inward. As a result, the single sheet medium A2 formed by cutting the long medium A1 also has a curl with the second surface S2 curved inward. As a result, when the single sheet medium A2 is conveyed through the intermediate roller 33, the sheet is curved in the direction opposite to the curl direction of the single sheet medium A2.

In other words, the single sheet medium A2 is conveyed and curved such that the second surface S2 faces outside in the direction opposite to the direction of the curl of the second surface S2 curled inward. In this manner, the curl is corrected by conveying the single sheet medium A2 through the intermediate roller 33 serving as a curving part so as to curve it in the direction opposite to the direction of the curl, while conveying the single sheet medium A2 at the second speed lower than the first speed (the second mode).

In addition, the control unit 58 may implement the second mode when the rear end portion (the downstream end A2*d* of the single sheet medium A2) of the single sheet medium A2 in the travelling direction is located at the intermediate roller 33. The reason for this is that the rear end portion easily makes contact with the head 22 of the printing unit 20 when it is conveyed by being sandwiched by only the downstream conveyance roller pair 36 past the upstream conveyance roller pair 35.

In addition, the control unit 58 includes a heating step of heating the single sheet medium A2 located at the intermediate roller 33 serving as a curving part in the second mode step. The control unit 58 may implement the heating step by driving the heating unit 60 when the front end portion (the upstream end A2*u* of the single sheet medium A2) of the single sheet medium A2 being conveyed through the intermediate roller 33 in the travelling direction toward the printing unit 20 is conveyed to a position immediately downstream of the most downstream driven roller 34, opposite the heating unit 60 (see FIG. 9). In any case, the heating step is implemented when the front end portion (the upstream end A2*u* of the single sheet medium A2) of the single sheet medium A2 in the travelling direction toward the printing unit 20 is located at the intermediate roller 33.

In addition, the control unit 58 may implement the heating step by driving the heating unit 60 when the rear end portion (the downstream end A2*d* of the single sheet medium A2) of the single sheet medium A2 being conveyed in the travelling direction toward the printing unit 20 is conveyed to a position immediately upstream of the most upstream driven roller 34, opposite the heating unit 60. In any case, the heating step is implemented when the rear end portion (the downstream end A2*d* of the single sheet medium A2) of the single sheet medium A2 in the travelling direction toward the printing unit 20 is located at the intermediate roller 33. In this case, the heating unit 60 may be disposed at a position upstream of the upstream driven roller 34.

In the heating step, the heating unit 60 injects the heat generated by the heater 61 to the single sheet medium A2 being conveyed in the forward direction D1 at the second speed through the use of the fan 62. In this manner, through the heating step using the heat, the curl is corrected by removing the residual stress of the single sheet medium A2 due to the winding shape as the curl.

The upstream side and the downstream side of the single sheet medium A2 are switched by the inversion path 30*b* such that the upstream end A2*u* becomes the most downstream end and the second surface S2 becomes the upper surface. Then, when the downstream end of the single sheet medium A2 has passed through the branch point P1, the control unit 58 switches, to the normal rotation, the driving of the upstream conveyance roller pair 35, the downstream conveyance roller pair 36, the first roller pair 37, and the second roller pair 38 that have been driven in the reverse rotation. In addition, when the single sheet medium A2 has passed through the confluence point P2, the control unit 58 drives, in the normal rotation, the supply roller pair 32 that has been stopped.

Figure 10:
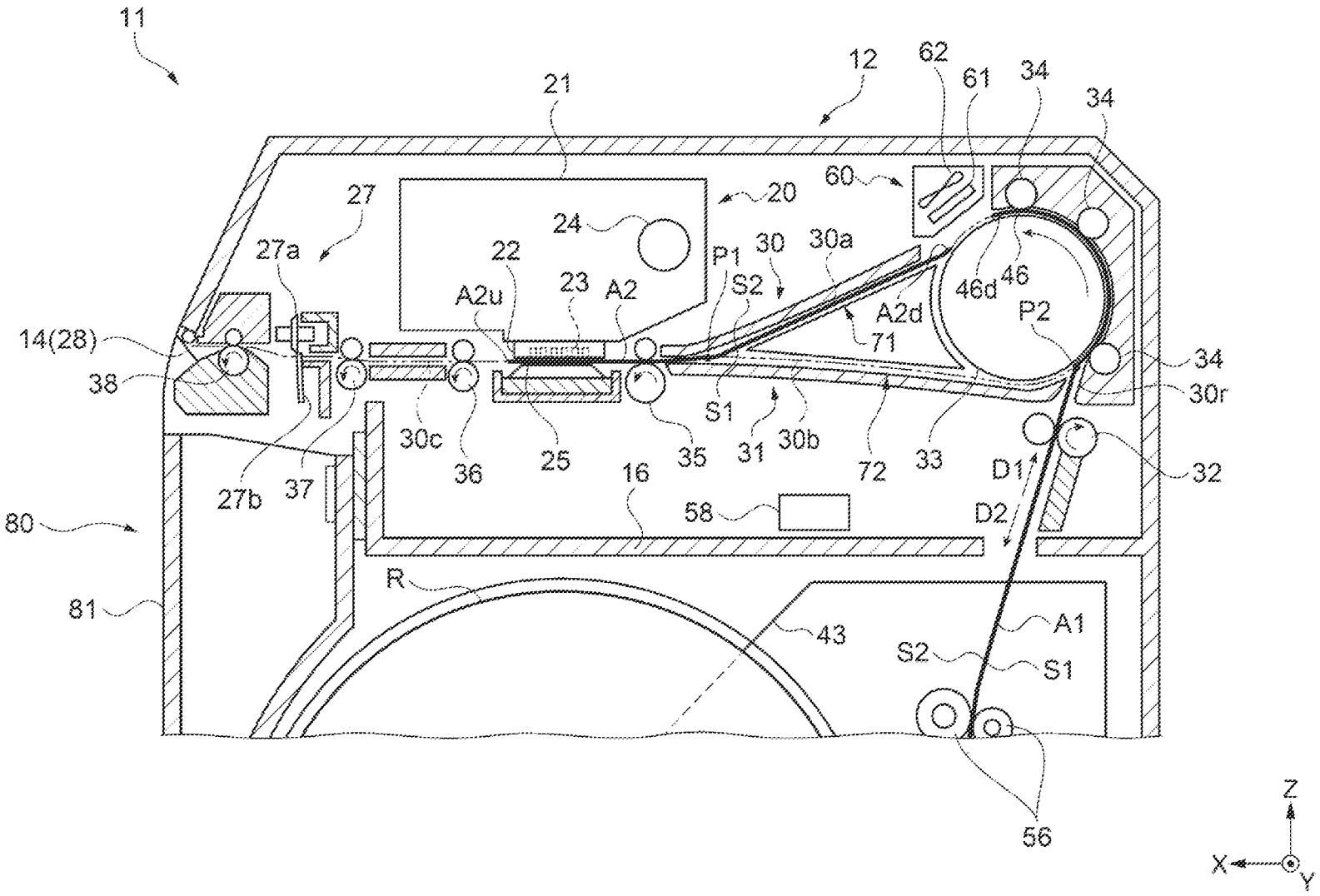
FIG. 10 is a sectional view illustrating a state where the single sheet medium is conveyed along the supply path to the supporting part.

As illustrated in FIG. 10, when the single sheet medium A2 is conveyed to the supporting part 25, the control unit 58 causes the printing unit 20 to perform printing by discharging the ink to the single sheet medium A2 located at the supporting part 25 while causing the conveyance unit 31 to convey the single sheet medium A2 in the forward direction D1. Specifically, the printing unit 20 performs printing on the second surface S2 of the single sheet medium A2.

When the single sheet medium A2 is conveyed to the supporting part 25, the control unit 58 at the same time starts the conveyance of the downstream end 46*d* of the base portion 46 of the long medium A1. Specifically, the control unit 58 starts the conveyance of the long medium A1 in the forward direction D1 by driving the supply roller pair 32 and the intermediate roller 33 in the normal rotation, and returns it to the supply path 30*a* from the confluence point P2. The long medium A1 is conveyed through the intermediate roller 33 and conveyed along the supply path 30*a* to the supporting part 25. Thereafter, the same operation as described above is performed.

In this case, since the curl of the single sheet medium A2 to the second surface S2 side is corrected through the second mode step implemented by the control unit 58, the end portions of the single sheet medium A2 on the upstream side and the downstream side can be prevented from being brought into contact with the head 22 of the printing unit 20, and the single sheet medium A2 can be prevented from being caught in the printing unit 20. Thereafter, the control unit 58 ejects the single sheet medium A2 on which printing has been performed on both surfaces (the first surface S1 and the second surface S2) to the outside of the printing apparatus 11 from the ejection port 14.

Through the series of operations described above, the duplex printing is performed on the single sheet medium A2.

The present embodiment can achieve the following effects.

In the present embodiment, the long medium A1 or the single sheet medium A2 formed by cutting the long medium A1 after the printing has a curl with the surface (in the present embodiment, the second surface S2) that faces inside when it is rolled in a roll shape, curved inward. Then, in the present embodiment, the surface (in the present embodiment, the second surface S2) of the single sheet medium A2 that faces inside when it is rolled in a roll shape and the surface (in the present embodiment, the first surface S1) of the single sheet medium A2 that faces inside when the single sheet medium A2 having been conveyed through the inversion path 30*b* is conveyed through the intermediate roller 33 serving as a curving part in a curved shape along the curved shape of the roller are different from each other. Accordingly, the control unit 58 performs a control of conveying the single sheet medium A2 at the second speed lower than the first speed of the first mode, as the second mode. Noted that when the long medium A1 is conveyed through the intermediate roller 33 serving as a curving part, the surface (in the present embodiment, the second surface S2) of the long medium A1 that faces inside when it is rolled in a roll shape and the surface (in the present embodiment, the second surface S2) of the long medium A1 that faces inside when it is curved along the curved shape of the roller are the same, and therefore the control unit 58 executes the first mode (the conveyance at the first speed).

With this configuration, the curl can be corrected by curving the single sheet medium A2 in the direction opposite to the direction of the curl direction, while slowly conveying it through the intermediate roller 33 (curving part) at the second speed lower than the first speed. In addition, since the curl is corrected, failures such as head rubbing and jam can be prevented.

According to the present embodiment, the heating unit 60 is provided at the intermediate roller 33. In the second mode, the control unit 58 causes the heating unit 60 to perform heating of the single sheet medium A2 located at the intermediate roller 33.

In this manner, the curl can be further corrected by removing the residual stress due to the winding shape as the curl by using the heat while curving the sheet in the direction opposite to the direction of the curl direction.

According to the present embodiment, when the front end portion (the upstream end A2*u*) of the single sheet medium A2 in the travelling direction toward the printing unit 20 is located at the intermediate roller 33 (curving part), the control unit 58 implements the second mode (the conveyance at the second speed and the heating at the heating unit 60).

With this configuration, the curl can be corrected.

According to the present embodiment, when the rear end portion (the downstream end A2*d* of the single sheet medium A2) of the single sheet medium A2 in the travelling direction toward the printing unit 20 is located at the intermediate roller 33 (curving part), the control unit 58 implements the second mode (the conveyance at the second speed).

With this configuration, the curl can be corrected.

According to the present embodiment, in a region opposite to the printing unit 20, the conveyance path 71 and the inversion path 72 overlap each other and convey the long medium A1 or the single sheet medium A2 in opposite directions.

With this configuration, the conveyance path 71 and the inversion path 72 can be used as a common path, and the path can be reduced in comparison with a configuration in which the conveyance path 71 and the inversion path 72 are separately disposed with no overlap. In this manner, the size of the printing apparatus can be reduced.

According to the present embodiment, the heating unit 60 includes the heater 61 and the fan 62.

With this configuration, the heating unit 60 can be achieved with a simple configuration, and the curl of the single sheet medium A2 can be corrected.

According to the present embodiment, the printing unit 20 performs ink-jet printing, and the control unit 58 executes the second mode for the single sheet medium A2.

With this configuration, the present disclosure can be readily applied to a printing apparatus that performs duplex printing on a roll sheet, which is currently in widespread use in the market, and the curl of the medium can be corrected. In this manner, failures such as head rubbing and jam can be prevented.

According to the present embodiment, the control unit 58 includes the first mode step and the second mode step for conveying the single sheet medium A2 at the second speed lower than the first speed of the first mode step.

With this control method, the same effect as that of the printing apparatus 11 described above can be achieved.

According to the present embodiment, the heating unit 60 is provided at the curving part, and the second mode step includes the heating step of performing heating of the single sheet medium A2 located at the intermediate roller 33 serving as a curving part.

With this control method, the same effect as that of the printing apparatus 11 described above can be achieved.

2. Second Embodiment

A general configuration of a printing apparatus 11A according to a second embodiment is described below.

In the printing apparatus 11A of the present embodiment, it is assumed for convenience of description that the roll sheet R is in the form of a roll of a long medium A3, and after printing is performed on the long medium A3, a single sheet medium A4 is formed by cutting the long medium A3. The long medium A3 and the single sheet medium A4 correspond to the long medium A1 and the single sheet medium A2 of the first embodiment.

Figure 11:
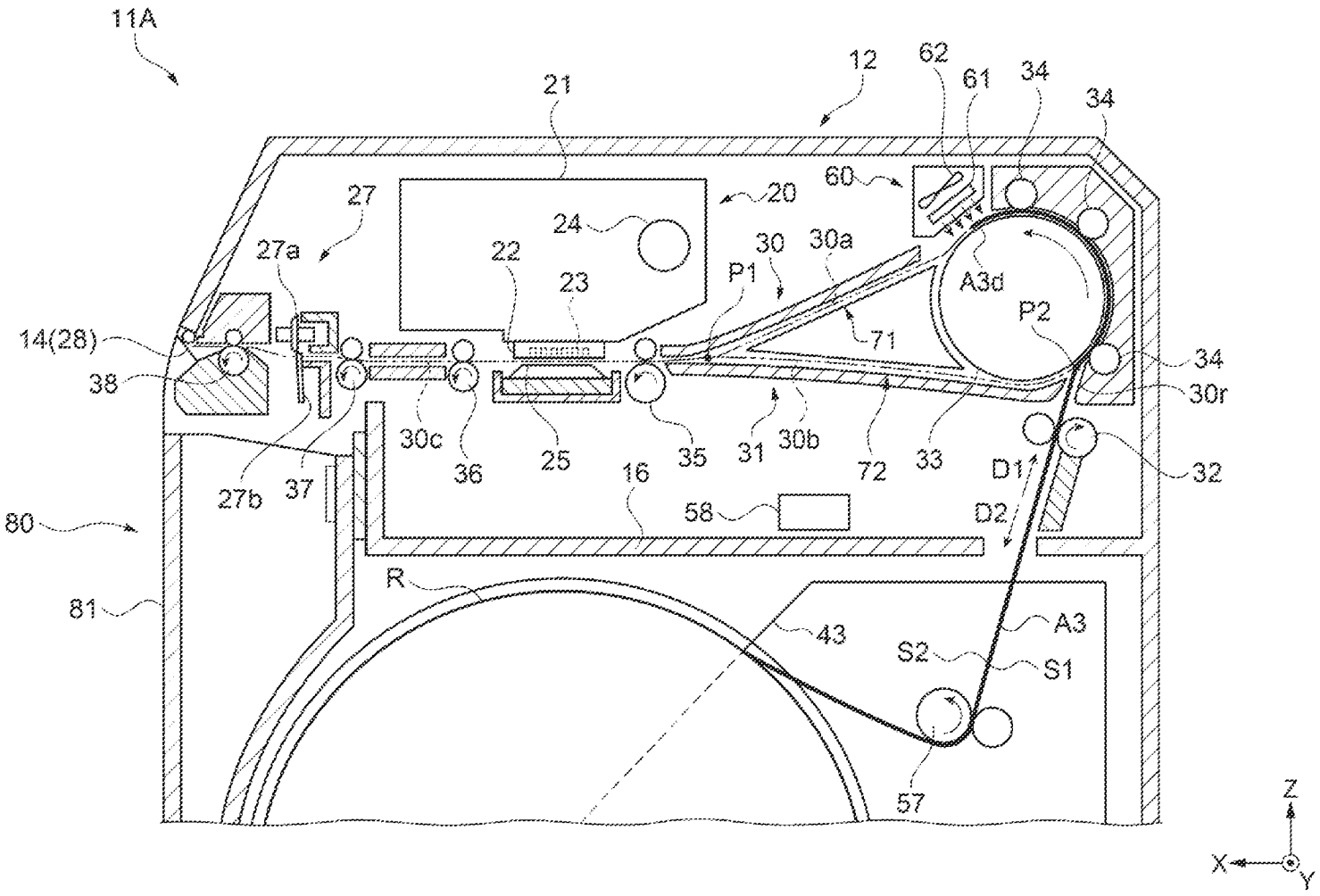
FIG. 11 is a sectional view illustrating a state where a long medium is conveyed along a supply path to a supporting part in a printing apparatus according to a second embodiment.

As a difference from the first embodiment, the front and rear directions of the long medium A3 when the roll sheet R is sent out are opposite to the directions of the first embodiment, as illustrated in FIG. 11. Therefore, the surface of the long medium A3 and the single sheet medium A4 on which printing is performed is different from that of the first embodiment. Other configurations are substantially the same as those of the first embodiment. The same configurations are denoted by the same reference numerals.

The surface of the long medium A3 on which printing is performed in the present embodiment is set as the first surface S1. In addition, the single sheet medium A4 is formed by cutting the long medium A3 after printing has been performed on the long medium A3, and the surface of the single sheet medium A4 on which printing is performed is set as the second surface S2. Therefore, in the present embodiment, the first surface S1 is the surface that faces inside when it is rolled in a roll shape, and the second surface S2 is the surface that faces outside when it is rolled in a roll shape as illustrated in FIG. 11.

Sending out of the roll sheet R is performed by a forward rotation of a roll sheet conveyance roller pair 57, which is additionally provided. In this case, the curl is basically a curl with the first surface S1, which is the surface that faces inside when it is rolled in a roll shape, inside. Accordingly, the conveyance at the roll sheet conveyance roller pair 57 also has an uncurling function.

Also in the present embodiment, the conveyance path 71 and the inversion path 72 are paths overlapping each other at the supporting part 25 as the region opposite to the printing unit 20, the ejection path 30*c*, and the cutting unit 27, and convey the long medium A3 or the single sheet medium A4 in opposite directions.

In the present embodiment, as in the first embodiment, the long medium A3 (the single sheet medium A4 formed by cutting it after printing) has a curl with the surface (in the present embodiment, the first surface S1) that faces inside when it is rolled in a roll shape, curved inward. In addition, as in the first embodiment, the control unit 58 executes the second mode in the case where the surface (in the present embodiment, the first surface S1) that faces inside when the long medium A3 or the single sheet medium A4 is rolled in a roll shape and the surface of the long medium A3 or the single sheet medium A4 that faces inside when the long medium A3 or the single sheet medium A4 is conveyed through the intermediate roller 33 serving as a curving part in a curved shape along the curved shape of the roller are different from each other. Noted that when the surfaces are the same, the control unit 58 executes the first mode.

In the present embodiment, when the long medium A3 sent out from the roll sheet R is conveyed through the intermediate roller 33, the surface (the first surface S1) of the long medium A3 that faces inside when it is rolled in a roll shape and the surface (in this case, the second surface S2) of the long medium A3 that faces inside when it is conveyed through the intermediate roller 33 in a curved shape are different from each other.

Therefore, the control unit 58 implements the second mode (the second mode step) when the front end portion (the downstream end A3*d* of the long medium A3) of the long medium A3 in the travelling direction toward the printing unit 20 is located at the intermediate roller 33 (curving part). In the second mode (the second mode step), the control unit 58 conveys the long medium A3 in the forward direction D1 by driving the conveyance unit 31 including the intermediate roller 33 in the normal rotation at the second speed lower than the first speed of the first mode. In addition, in the second mode (the second mode step), the control unit 58 implements the heating (heating step) at the heating unit 60 for the long medium A3 located at the intermediate roller 33 serving as a curving part.

In this manner, the curl can be corrected by curving the long medium A3 being conveyed through the intermediate roller 33 in the direction opposite to the direction of the curl direction while slowly conveying it at the second speed. In addition, at the same time, through the heating (heating step) at the heating unit 60 for the long medium A3 being conveyed through the intermediate roller 33, the curl is corrected by removing the residual stress of the single sheet medium A4 due to the winding shape as the curl by using the heat.

After the curl is corrected, the long medium A3 is conveyed through the conveyance path 71, and the single sheet medium A4 is formed through printing and cutting as in the first embodiment. The single sheet medium A4 thus formed is conveyed through the inversion path 72 and inverted upside down as in the first embodiment.

Figure 12:
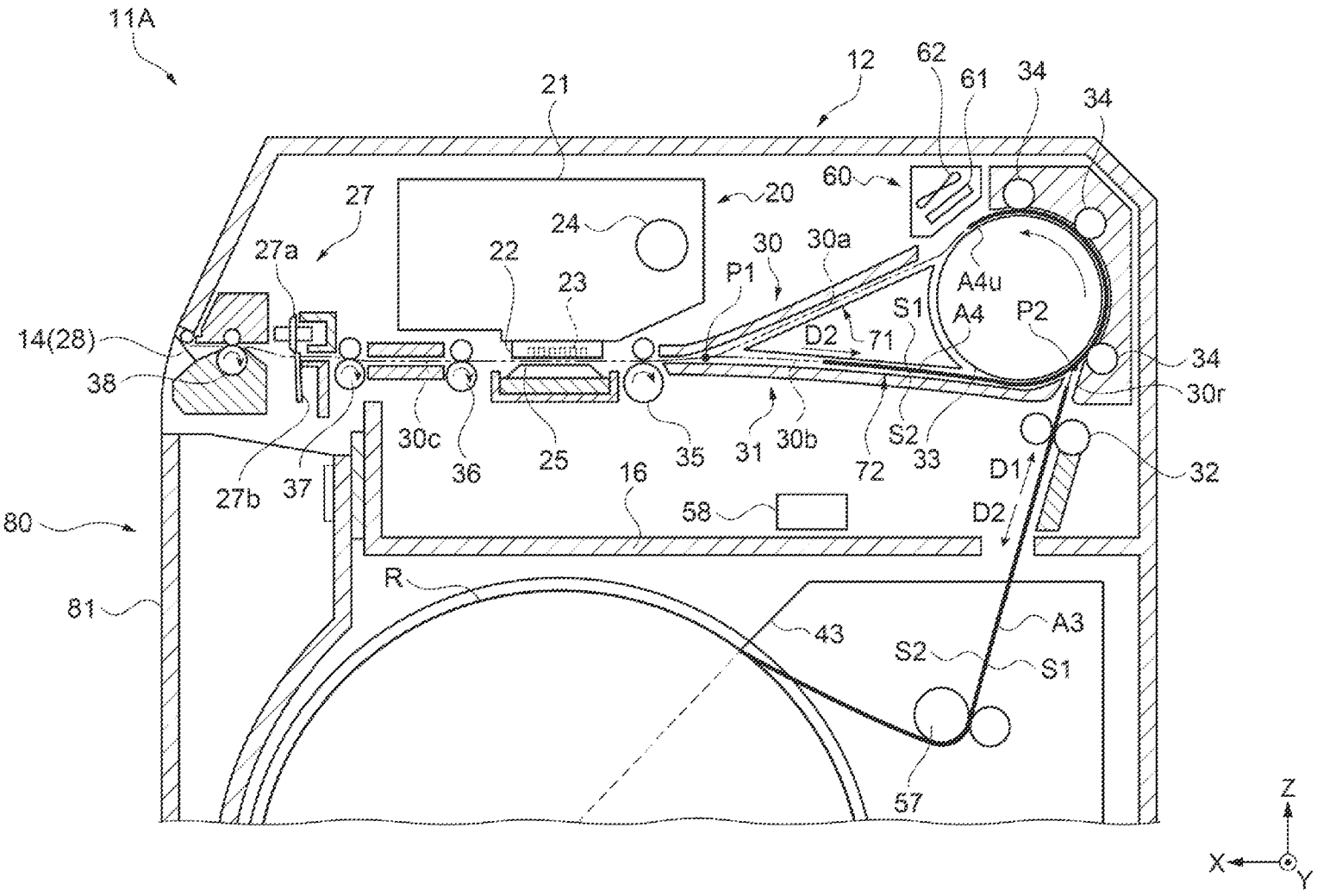
FIG. 12 is a sectional view illustrating a state where the single sheet medium is inverted upside down at the inversion path.

As illustrated in FIG. 12, in the present embodiment, in the case where the single sheet medium A4 is conveyed through the intermediate roller 33 in the inversion path 72, the surface (the first surface S1) of the single sheet medium A4 that faces inside when it is rolled in a roll shape and the surface (in this case, the first surface S1) of the single sheet medium A4 that faces inside when it is conveyed through the intermediate roller 33 in a curved shape are the same. Therefore, for the single sheet medium A4, the control unit 58 drives the conveyance unit 31 including the intermediate roller 33 in the first mode for conveying the single sheet medium A4 at the first speed. In the conveyance of the first mode, the heating is not performed even when an upstream end A4*u* (the front end portion in the travelling direction toward the printing unit 20) of the single sheet medium A4 is located at a position opposite to the heating unit 60.

Printing is performed at the printing unit 20 on the second surface S2 of the single sheet medium A4 conveyed at the first speed. Thereafter, the control unit 58 ejects the single sheet medium A4 on which printing has been performed on both surfaces (the first surface S1 and the second surface S2) to the outside of the printing apparatus 11A from the ejection port 14.

Through the series of operations described above, duplex printing on the single sheet medium A4 is performed.

The present embodiment can achieve the following effects.

In the present embodiment, the long medium A3 or the single sheet medium A4 formed by cutting the long medium A3 after printing has a curl with the surface (in the present embodiment, the first surface S1) that faces inside when it is rolled in a roll shape, curved inward. Then, in the present embodiment, the surface (in the present embodiment, the first surface S1) of the long medium A3 that faces inside when it is rolled the long medium A3 and the surface (in the present embodiment, the second surface S2) of the single sheet medium A4 that faces inside when it is conveyed through the intermediate roller 33 serving as a curving part in a curved shape along the curved shape of the roller are different from each other. Accordingly, the control unit 58 performs a control of conveying the long medium A3 at the second speed lower than the first speed of the first mode, as the second mode. Noted that in the case where the single sheet medium A4 is conveyed through the intermediate roller 33 serving as a curving part, the surface (in the present embodiment, the first surface S1) of the single sheet medium A4 that faces inside when it is rolled in a roll shape and the surface (in the present embodiment, the first surface S1) of the single sheet medium A4 that faces inside when it is curved along the curved shape of the roller are the same, and therefore the control unit 58 executes the first mode (the conveyance at the first speed).

With this configuration, the curl can be corrected by curving the long medium A3 in the direction opposite to the direction of the curl direction, while slowly conveying it through the intermediate roller 33 (curving part) at the second speed lower than the first speed. In addition, since the curl is corrected, failures such as head rubbing and jam can be prevented.

According to the present embodiment, the heating unit 60 is provided at the intermediate roller 33. In the second mode, the control unit 58 causes the heating unit 60 to perform heating of the long medium A3 located at the intermediate roller 33.

In this manner, the curl can be further corrected by removing the residual stress due to the winding shape as the curl by using the heat while curving the sheet in the direction opposite to the direction of the curl direction.

According to the present embodiment, when the front end portion (the downstream end A3*d* of the long medium A3) of the long medium A3 in the travelling direction toward the printing unit 20 is located at the intermediate roller 33 (curving part), the control unit 58 implements the second mode (the conveyance at the second speed and the heating at the heating unit 60).

With this configuration, the curl can be corrected.

According to the present embodiment, in the region opposite to the printing unit 20, the conveyance path 71 and the inversion path 72 overlap each other and convey the long medium A3 or the single sheet medium A4 in opposite directions.

With this configuration, the conveyance path 71 and the inversion path 72 can be used as a common path, and the path can be reduced in comparison with a configuration in which the conveyance path 71 and the inversion path 72 are separately disposed with no overlap. In this manner, the size of the printing apparatus can be reduced.

According to the present embodiment, the heating unit 60 includes the heater 61 and the fan 62.

With this configuration, the heating unit 60 can be achieved with a simple configuration, and the curl of the long medium A3 can be corrected.

According to the present embodiment, the control unit 58 includes the first mode step, and the second mode step for conveying the long medium A3 at the second speed lower than the first speed of the first mode step.

With this control method, the same effect as that of the printing apparatus 11A described above can be achieved.

According to the present embodiment, the heating unit 60 is provided at the curving part, and the second mode step includes the heating step of heating the long medium A3 located at the intermediate roller 33 serving as a curving part.

With this control method, the same effect as that of the printing apparatus 11A described above can be achieved.

3. Modification 1

In the first embodiment, in the implementation of the second mode, the speed is controlled at the second speed when the front end portion of the single sheet medium A2 in the travelling direction (the upstream end A2*u* of the single sheet medium A2) is located at the intermediate roller 33 serving as a curving part. In addition, the heating unit 60 performs the heating in the state where the front end portion (the upstream end A2*u* of the single sheet medium A2) in the travelling direction is located at a position downstream of the last the driven roller 34 (just before it leaves the intermediate roller 33). However, the heating unit 60 may be operated at the time when the front end portion (the upstream end A2*u* of the single sheet medium A2) in the travelling direction is located at the intermediate roller 33. In this case, the heating unit 60 may be disposed on the side upstream of the upstream driven roller 34. The same applies to the case where the second mode is implemented in the second embodiment.

4. Modification 2

In the first embodiment, in the implementation of the second mode, the speed is controlled at the second speed when the rear end portion (the downstream end A2*d* of the single sheet medium A2) of the single sheet medium A2 in the travelling direction is located at the intermediate roller 33 serving as a curving part. In addition, the heating unit 60 performs the heating in the state where the rear end portion (the downstream end A2*d* of the single sheet medium A2) in the travelling direction is located upstream of the first driven roller 34. However, the heating unit 60 may be operated at the time when the rear end portion (the downstream end A2*d* of the single sheet medium A2) in the travelling direction is located at the intermediate roller 33. Also in this case, the heating unit 60 may be disposed also on the side upstream of the upstream driven roller 34.

5. Modification 3

In the first embodiment, it suffices that, when the second mode is implemented, the period in which the single sheet medium A2 is conveyed at the second speed is at least a period in which the single sheet medium A2 is located at the intermediate roller 33. Noted that when the second mode is implemented in the second embodiment, the period in which the long medium A3 is conveyed at the second speed may be appropriately set.

6. Modification 4

In the first embodiment, it suffices that when the second mode is implemented, the heating at the heating unit 60 is performed at least on the portion of the upstream end A2*u* of the single sheet medium A2, or in other words, the front end portion in the travelling direction toward the printing unit 20. In this manner, head rubbing and jam can be prevented at the printing unit 20. Noted that it suffices that, also in the case where the second mode is implemented in the second embodiment, the heating at the heating unit 60 is performed at least on the portion of the downstream end A3*d* of the long medium A3, or in other words, the front end portion in the travelling direction toward the printing unit 20.

7. Modification 5

In the first embodiment, it suffices that when the second mode is implemented, the heating at the heating unit 60 is performed at least on the portion of the downstream end A2*d* of the single sheet medium A2, or in other words, the rear end portion in the travelling direction toward the printing unit 20. In this manner, head rubbing and jam can be prevented at the printing unit 20.

8. Modification 6

In the first embodiment, when the second mode is implemented, the single sheet medium A2 is conveyed at the second speed lower than the first speed of the first mode. However, this is not limitative, and the second speed lower than the first speed may include stop. Noted that the seconds (duration) of the stop, the temperature (intensity) and seconds (duration) of the heating and the like may be appropriately set by experiments.

With this configuration, the single sheet medium A2 is curved in the direction opposite to the curl direction and stopped in the state where it is along the curve of intermediate roller 33. In this manner, the curl can be corrected. In addition, by performing the heating on the stopped single sheet medium A2 at the heating unit 60, the curl can be further reliably corrected. The same applies to the case where the second mode is implemented in the second embodiment.

9. Modification 7

In the first embodiment, when the second mode is implemented, the degree (level) of the curl due to the curvature of the long medium A1 when it is rolled in a roll shape is not taken into account. However, the state of the second mode (such as the speed and the heating temperature) may be controlled in accordance with the curvature of the long medium A1 when it is rolled in a roll shape. In this case, by providing a position detection sensor such as an optical sensor in the support wall 43 of the roll sheet housing unit 40 or the like and by calculating the curvature through detection of the position of the sending long medium A1 in the cross-sectional direction in the roll sheet R, the state of the second mode including the second speed, the heating temperature at the heating unit 60 and the like can be controlled based on the calculated curvature.

With this configuration, the curl can be properly corrected. The same applies to the case where the second mode is implemented in the second embodiment.

10. Modification 8

In the first embodiment, the intermediate roller 33 is a part of the conveyance path 71 serving as a curving part, and the curving part constitutes a curved path. The outer peripheral surface of the intermediate roller 33 forms the inner wall of the curved path. Noted that the intermediate roller 33 is a roller having a larger diameter than other rollers. In other words, the inner wall of the curved path for the conveyance at the curving part is formed with the outer peripheral surface of a large diameter roller.

With this configuration, the mechanism that transmits the conveyance force at the curved path can be simplified. Thus, the curl of the long medium or the single sheet medium can be easily corrected. It is conceivable to dispose a plurality of rollers in the conveyance direction of the curved path, but in this case, it is necessary to transmit the power to each of the plurality of rollers, and the transmission mechanism is complicated. In contrast, with the configuration composed of one large diameter roller, it is only need to transmit the power to the large diameter roller, and thus the transmission mechanism can be simplified and downsized. The same applies to the second embodiment.

11. Modification 9

In the first embodiment, the heating unit 60 heats the single sheet medium A2 from the outside of the curving part (the intermediate roller 33). However, this is not limitative, and the heating unit may heat it from the inside of the curving part, as schematically illustrated by heating unit 60*b* in FIG. 3. Accordingly, for example, the single sheet medium A2 may be heated from the inside of the intermediate roller 33 serving as a curving part.

With this configuration, with the heating unit configured inside the curving part, the size of the heating unit can be reduced. The same applies to the second embodiment.

12. Modification 10

In the first embodiment, the heating unit 60 is composed of the heater 61 and the fan 62. However, this is not limitative, and the heating unit may use a heat roller. Noted that in the case where a heat roller is used, it is preferable to have a cylindrical shape that can heat the medium over the entire width direction. In addition, the heat roller is disposed inside the curving part (for example, inside the intermediate roller 33), as schematically illustrated by heating unit 60*b* in FIG. 3.

Also with this configuration, the configuration of the heating unit can be simplified, and the size of the heating unit can be reduced. The same applies to the second embodiment.

What is claimed is:

1. A printing apparatus comprising:

a curving part configured to convey a medium in a curved state;

a printing unit configured to perform printing on the medium;

a cutting unit configured to cut the medium on which printing was performed;

an ejection part configured to eject the cut medium;

a conveyance path including a conveyance unit configured to convey the medium through the curving part, the printing unit, the cutting unit, and the ejection part in this order;

an inversion path configured to invert a single sheet medium upside down and merge the single sheet medium into an upstream part of the curving part of the conveyance path for printing on a second surface, the single sheet medium being formed by cutting a long medium on which printing was performed on a first surface, the medium being initially the long medium having a roll shape; and a control unit configured to control the conveyance unit, wherein in conveyance of the long medium or the single sheet medium at the curving part, the control unit controls the conveyance unit in a first mode and a second mode to convey the long medium or the single sheet medium toward the printing unit, the control unit controlling the conveyance unit in the first mode and the second mode based, at least in part, upon an orientation of the long medium sent out from a roll sheet associated with the printing apparatus, the first mode being a mode for conveying the long medium or the single sheet medium at a first speed when a surface of the long medium or the single sheet medium being conveyed that faces inside when the long medium or the single sheet medium is rolled in a roll shape, and a surface of the long medium or the single sheet medium that faces inside of a curved shape when the long medium or the single sheet medium is conveyed through the curving part are the same, and the second mode being a mode for conveying the long medium or the single sheet medium at a second speed lower than the first speed of the first mode when the surface of the long medium or the single sheet medium being conveyed that faces inside when the long medium or the single sheet medium is rolled in the roll shape, and the surface of the long medium or the single sheet medium that faces inside of the curved shape when the long medium or the single sheet medium is conveyed through the curving part are different from each other.

2. The printing apparatus according to claim 1, wherein a heating unit is provided at the curving part, and in the second mode, the control unit causes the heating unit to perform heating of the long medium or the single sheet medium located at the curving part.

3. The printing apparatus according to claim 2, wherein the heating unit includes a heater and a fan.

4. The printing apparatus according to claim 2, wherein the heating unit performs heating from inside of the curving part.

5. The printing apparatus according to claim 2, wherein the heating unit uses a heat roller.

6. The printing apparatus according to claim 1, wherein the second mode is performed by the control unit when a front end portion of the long medium or the single sheet medium in a travelling direction toward the printing unit is located at the curving part.

7. The printing apparatus according to claim 1, wherein the second mode is performed by the control unit when a rear end portion of the single sheet medium in a travelling direction toward the printing unit is located at the curving part.

8. The printing apparatus according to claim 1, wherein the second mode includes stop as the second speed.

9. The printing apparatus according to claim 1, wherein in a region opposite to the printing unit, the conveyance path and the inversion path overlap each other and convey the long medium or the single sheet medium in opposite directions.

10. The printing apparatus according to claim 1, wherein the control unit controls a state of the second mode in accordance with a curvature of the long medium or the single sheet medium when the long medium or the single sheet medium is rolled in the roll shape.

11. The printing apparatus according to claim 1, wherein an inner wall of a curved path for conveyance at the curving part is formed by an outer peripheral surface of a large diameter roller.

12. The printing apparatus according to claim 1, wherein the printing unit performs ink-jet printing; and the control unit executes the second mode for the single sheet medium.

13. A conveyance control method of a medium using a printing apparatus configured to perform printing on the medium, the medium being initially a long medium having a roll shape, the printing apparatus comprising:

a curving part configured to convey a medium in a curved state;

a printing unit configured to perform printing on the medium;

a cutting unit configured to cut the medium on which printing was performed;

an ejection part configured to eject a cut medium;

a conveyance path including a conveyance unit configured to convey the medium through the curving part, the printing unit, the cutting unit, and the ejection part in this order; and an inversion path configured to invert a single sheet medium upside down and merge the single sheet medium into an upstream part of the curving part of the conveyance path for printing on a second surface, the single sheet medium being formed by cutting the long medium on which printing was performed on a first surface, the method comprising, in conveyance of the long medium or the single sheet medium at the curving part:

a first mode step for conveying the long medium or the single sheet medium at a first speed when a surface of the long medium or the single sheet medium being conveyed that faces inside when the long medium or the single sheet medium is rolled in a roll shape, and a surface of the long medium or the single sheet medium that faces inside of a curved shape when the long medium or the single sheet medium is conveyed through the curving part are the same, and a second mode step for conveying the long medium or the single sheet medium at a second speed lower than the first speed of the first mode step when the surface of the long medium or the single sheet medium being conveyed that faces inside when the long medium or the single sheet medium is rolled in the roll shape, and the surface of the long medium or the single sheet medium that faces inside of the curved shape when the long medium or the single sheet medium is conveyed through the curving part are different from each other, controlling between the first mode step and the second mode step is based, at least in part, upon an orientation of the long medium sent out from a roll sheet associated with the printing apparatus.

14. The method according to claim 13, wherein a heating unit is provided at the curving part of the printing apparatus; and the second mode step includes a heating step of heating the long medium or the single sheet medium located at the curving part.

* * * * *